United States Patent [19]

Bennett et al.

[11] Patent Number: 5,034,736

[45] Date of Patent: Jul. 23, 1991

[54] BISTABLE DISPLAY WITH PERMUTED EXCITATION

[75] Inventors: Stewart Bennett, Concord; Leonard Polizzotto, Stow, both of Mass.

[73] Assignee: Polaroid Corporation, Cambridge, Mass.

[21] Appl. No.: 393,256

[22] Filed: Aug. 14, 1989

[51] Int. Cl.[5] ..... G09G 3/36

[52] U.S. Cl. ..... 340/784; 340/719; 340/811

[58] Field of Search ..... 340/765, 784, 811-814, 340/719, 718; 350/331 R, 332, 333; 358/236

[56] References Cited

U.S. PATENT DOCUMENTS

| | | | |
|---|---|---|---|
| 4,224,616 | 5/1980 | Kamagata et al. | 340/753 |
| 4,302,756 | 11/1981 | Frankland | 340/802 |
| 4,317,115 | 2/1982 | Kawakami et al. | 340/784 |
| 4,325,064 | 4/1982 | Kishino et al. | 340/753 |
| 4,548,476 | 11/1985 | Kaneko | 350/350 S |
| 4,633,242 | 12/1986 | Sekiya | 340/784 X |
| 4,638,310 | 1/1987 | Ayliffe | 340/805 |
| 4,644,344 | 2/1987 | Larsen et al. | 340/811 X |
| 4,655,550 | 4/1987 | Crossland et al. | 350/332 |
| 4,759,609 | 7/1988 | Clerc | 340/784 X |
| 4,922,240 | 5/1990 | Duwaer | 350/333 X |

*Primary Examiner*—Ulysses Weldon

*Attorney, Agent, or Firm*—Louis G. Xiarhos

[57] ABSTRACT

A liquid-crystal display system includes a display having a bistable liquid-crystal material, such as a ferroelectric material, and two sets of electrodes disposed substantially perpendicularly to each other and on opposite sides of a layer of the liquid-crystal material. In each set of electrodes, drive circuitry is connected via resistors to front terminals of each of the electrodes, and via resistors to back terminals of each of the electrodes. The drive circuitry provides further that drivers having equal number of output drive ports are coupled via a network of electrical conductors to the front terminals and the back terminals of electrodes in each set of the electrodes in accordance with an arrangement wherein the front terminals are arranged in groups such that, within each group, the front terminals are connected to corresponding ports of a driver. A similar arrangement is provided for the connection of the back ports to a driver subject to the proviso that the terminals in the various groups are coupled to the driver ports by a permuted arrangement allowing each electrode in a set of electrodes to be unambiguously identified by a pair of driver ports wherein one port of the pair is in the driver connected to the front terminals of the electrodes and the other port is in the driver connected to the back terminals of the set of electrodes.

8 Claims, 4 Drawing Sheets

BISTABLE DISPLAY WITH PERMUTED EXCITATION

BACKGROUND OF THE INVENTION

This invention relates to liquid-crystal displays and, more particularly, to a display employing a bistable liquid-crystal medium such as a ferroelectric material.

Liquid-crystal displays are employed frequently in numerous situations for the presentation of both alphanumeric data and pictorial data. The image presented on the display is composed of an array of pixels disposed in a matrix of rows and columns. In the typical construction of a liquid-crystal display, a layer of nematic liquid-crystal material is disposed between two layers of electrode structure. One of the electrode structures, the top electrode structure by way of example, is formed as a set of column conductors and the other electrode structure, namely the bottom electrode structure, is formed as a set of row conductors.

A characteristic of a display formed of twisted nematic or super-twisted nematic liquid-crystal material is the need to continuously repeat excitation of each pixel. Each pixel is formed at the intersection of a row conductor and a column conductor by the development of an electric field between the row conductor and the column conductor. The electric field alters the state of the liquid-crystal material to impart rotation of an electric vector of light propagating through the liquid-crystal material. The light propagates in a direction perpendicular to a plane of an electrode structure. It is the practice to employ alternating voltage to excite the electrode structures so as to avoid an electrochemical reaction between the electrode structures and the liquid crystal material.

In the presence of an applied electric field, the nematic liquid-crystal material undergoes the aforementioned change in state to impart the rotation to the electric vector. However, upon release of the applied electric field, the nematic liquid-crystal material returns to its original state thereby terminating the rotation of the electric vector of the light. Therefore, with nematic liquid-crystal displays, it is the practice to continuously retransmit electrical signals along the electrodes of the top and the bottom of electrode structures to refresh the displayed image at sufficient frequency to provide a person viewing the image with an image that appears to be present continuously.

Another form of liquid-crystal display employs a bistable material such as a ferroelectric-crystal material. Until recently, such displays found little use because the liquid-crystal material is operative only at elevated temperatures, such as 70 degrees centigrade. However, there is available now a ferroelectric liquid-crystal material which is operative at room temperature. Therefore, such displays could be employed in the numerous situations wherein nematic liquid-crystal displays are presently employed.

A problem arises in that presently available electronic systems for activating liquid-crystal displays do not take advantage of the bistable characteristic of ferroelectric liquid-crystal material. In particular, it is noted that the bistable characteristic allows the display to be operated without the need for repetitive refreshing of the image. Rather, a single pulse of electric field of sufficient strength is adequate to permanently alter the state of the liquid-crystal material, the state being maintained until an electric field of opposite sense is applied to restore the original state of the liquid-crystal material. Thus, a single pulse of electric field suffices to induce a rotation of the electric field vector of light propagating through the display at the site of a pixel; the pixel maintains its state of illumination until such time as a pulse of electric field of the reverse sense is applied to the ferroelectric liquid-crystal material by the electrode structures. The freedom from the need of continuous refreshing of the display, provided by the bistable liquid-crystal material, should allow for simplification of electric drive circuitry, as well as the capacity to drive significantly larger displays than has been done heretofore.

SUMMARY OF THE INVENTION

The foregoing problem is overcome and other advantages, particularly a simplification of electric drive circuitry and the capacity to drive larger liquid-crystal displays, is provided by drive circuitry of the invention. The drive circuitry of the invention employs a reduced number of line drivers for activation of the row and the column electrodes of a liquid-crystal display employing bistable liquid-crystal material, and also allows for a faster response in the case of ferroelectric liquid-crystal material because the ferroelectric liquid-crystal material responds faster than nematic liquid-crystal material to electrical excitation.

In accordance with the invention, bistable liquid-crystal material, particularly ferroelectric liquid-crystal material, is disposed between a top layer of column electrodes and a bottom layer of row electrodes, all of the electrodes being formed as strip conductors.

Each of the electrodes of the top set of electrodes of the top structure and of the bottom set of electrodes of the bottom structure is energized by means of a pair of resistors connected at opposed ends of the electrode. The resistors of each electrode are connected further to a source of electric current comprised of a pair of drivers. All of the electrodes of the top set are energized by a pair of drivers connected to the resistors. Similarly, the electrodes of the bottom set are energized by a further pair of drivers connected to the resistors of each electrode. The drivers of the top set of electrodes, when activated, impart a voltage pulse of a predetermined polarity, such as a positive polarity, to an electrode of a designated pixel. The drivers for the electrodes of the bottom set, when activated, impart voltage pulses of the opposite plurality, negative pulses, to the electrodes of designated pixels. The bistable liquid-crystal material at the site of a pixel, namely the intersection of a top and a bottom electrode, is placed in one state in response to the electric field of the positive voltage, and in the opposite state in response to the electric field of the negative voltage.

An important feature of the invention is the grouping of electrodes in both the top and the bottom sets of electrodes to provide for interconnection of terminals of the resistors to terminals of the drivers. Each of the drivers has a plurality of output ports. Resistors of a plurality of electrodes from different electrode groups are connected to a single port of a driver. The grouping is accomplished in accordance with a preset order in which a first resistor in each group of electrodes is connected to a first output port of a driver. The second and subsequent ones of the resistors from each electrode group are connected to a second and subsequent ones of the driver ports.

A similar arrangement is provided with respect to the resistor terminals at the opposite ends of the electrodes subject to the proviso that, prior to connecting the resistors to the output ports of a driver, the connections of the resistors are to be permuted. The permutation of the interconnections of resistor terminals with driver ports is accomplished such that a first port is connected to a first resistor in a first group of electrodes, and to a second resistor in a second group of electrodes, and to a third resistor in a third group of electrodes, the connecting scheme continuing until a connection has been provided with one resistor in each group. The second driver port connects with the second resistor in the first electrode group, with the third resistor in the second electrode group, the scheme continuing throughout the remainder of the groups. Similarly, a third driver port connects with a third resistor in the first electrode group, a fourth terminal of the second electrode group, a third terminal of the fifth electrode group, the permuting scheme continuing through the balance of the terminals of the subsequent groups.

The same system of grouping connections at one end of the electrodes and of permuting the connections at the opposite ends of the electrodes is provided for the second set of electrodes. Thereby, any one of the electrodes of the top set can be activated by a choice of a pair of ports from the two drivers operatively coupled to the top set of electrodes. Similarly, any one of the electrodes of the bottom set can be selectively activated by a choice of a pair of ports of the two drivers operatively coupled to the bottom set of electrodes. By choosing the four ports, the liquid-crystal material at any selected pixel can be provided with a requisite state to impart or delete a specific value of rotation to the electric vector of light passing through the display. This arrangement results in a great savings of driver equipment because four drivers are capable of handling a number of pixels previously requiring a relatively large number of drivers.

If desired, the scheme of electrical interconnection of the electrodes to the drivers by grouping and by permutation of connections can be applied with other forms of liquid-crystal displays such as displays employing nematic liquid-crystal material. However, full advantage of the interconnection system and of all the features of the invention are attained by employing the interconnection system of the invention with a liquid-crystal display employing a bistable liquid-crystal material.

BRIEF DESCRIPTION OF THE DRAWING

The aforementioned aspects and other features of the invention are explained in the following description, taken in connection with the accompanying drawing wherein.

DETAILED DESCRIPTION

Figure 1:
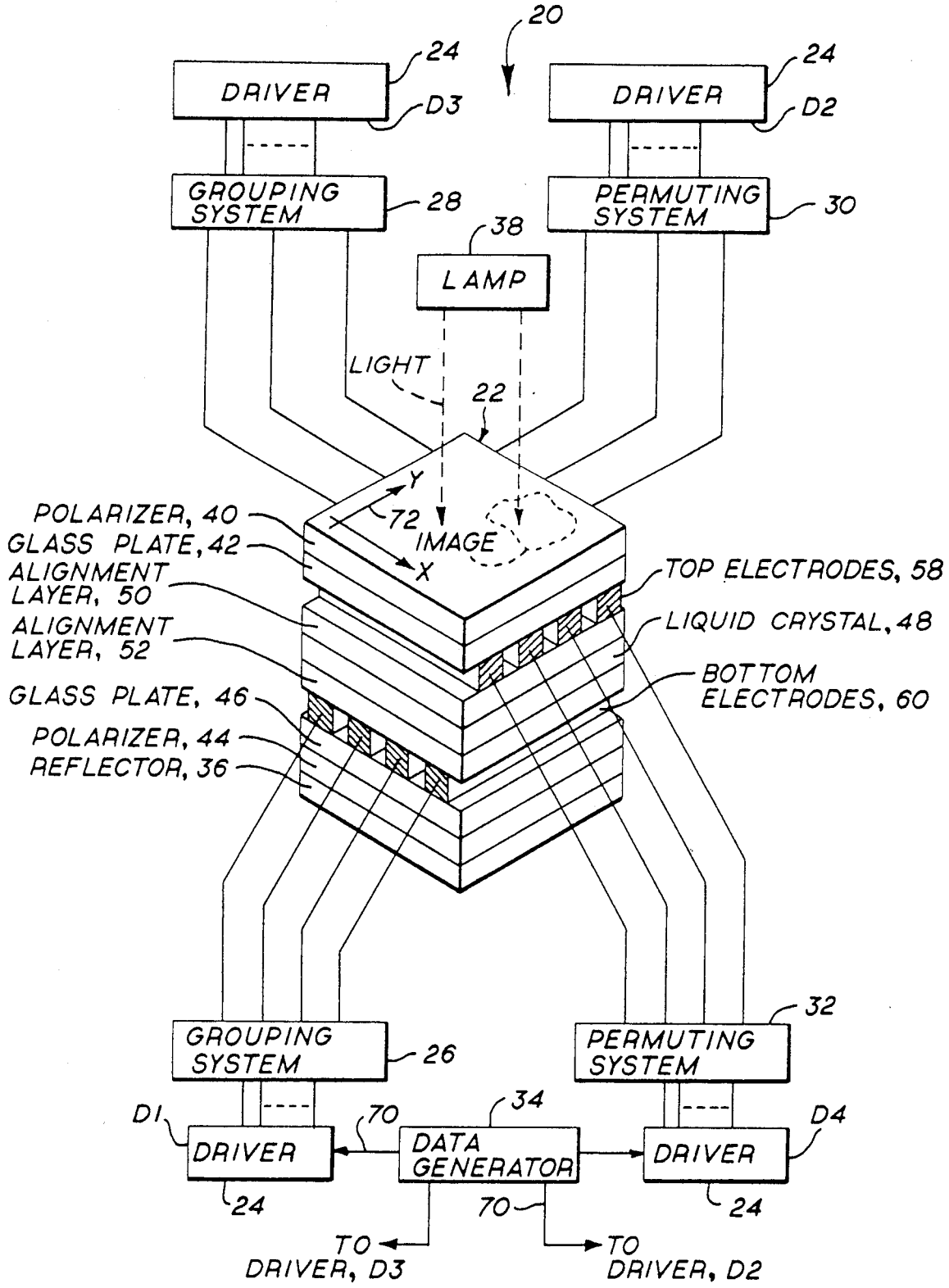
FIG. 1 is a stylized diagrammatic view of a liquid-crystal display activated by circuitry of the invention.
Figure 2:
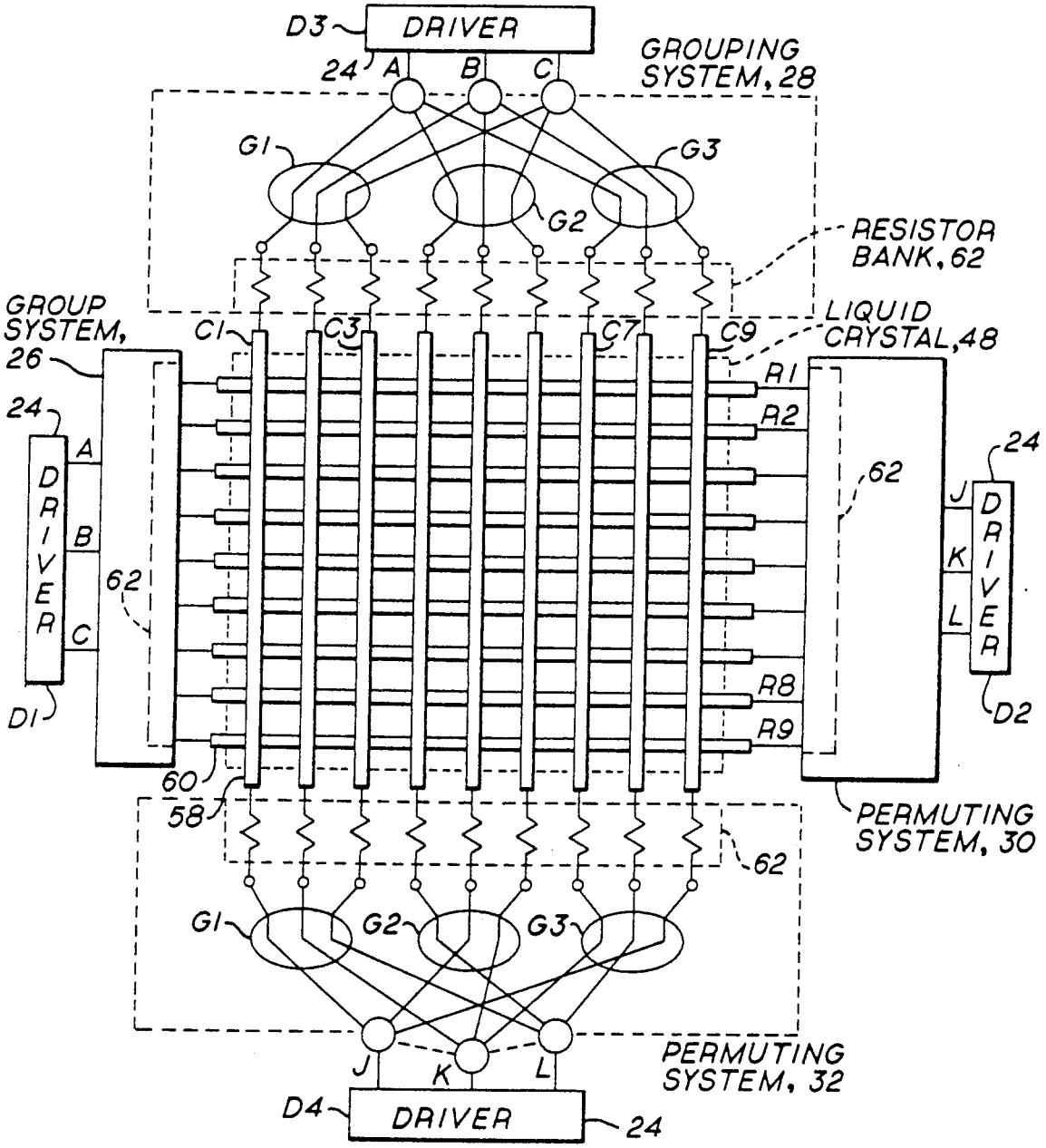
FIG. 2 shows diagrammatically a plan view of top and bottom sets of electrodes disposed about a layer of bistable liquid-crystal material, the figure further showing a grouping and a permuting of interconnections of the ends of the electrodes with output ports of a set of four drivers.
Figure 3:
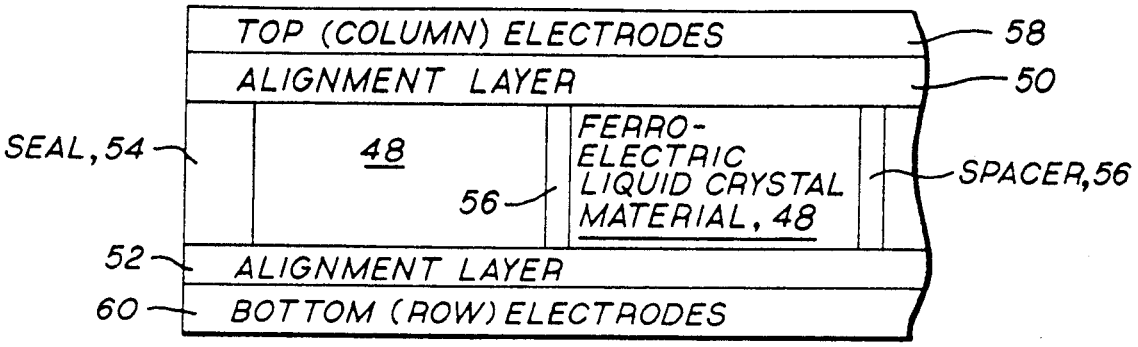
FIG. 3 shows diagrammatically an enlarged view of a portion of the display of FIG. 1.

With reference to FIGS. 1, 2, and 3, there is shown a display system 20 constructed in accordance with the invention and comprising a liquid-crystal display 22 electrically activated by four drivers 24 wherein individual ones of the drivers 24 are further identified by the legends D1, D2, D3, and D4. The drivers D1 and D3 are connected to the display 22 by grouping systems 26 and 28, respectively. The drivers D2 and D4 are connected to the display 22 by permuting systems 30 and 32, respectively. Data which is to be imaged on the display 22 is provided by a data generator 34 connected to each of the four drivers 24. The principles of the invention apply to a liquid-crystal display operated by transmitting incident light through the display from a back side thereof to a front side thereof at which the image is to be seen, or via a reflecting type display in which light, incident at a front of the display, is reflected back through the display to present the image at the front of the display. By way of example, the latter form of display is presented in FIG. 1 wherein the display 22 is provided with a reflector 36, shown as a bottom layer in the structure of the display 22, with incident light being provided by a lamp 38 positioned in front of the display 22.

The display 22 is constructed of a series of layers, there being a polarizer 40 disposed as the top-most layer located at the front of the display 22. The polarizer 40 may be supported by a glass plate 42. A further polarizer 44 is disposed between the reflector 36 and a further glass plate 46, the latter serving as a support for the polarizer 44.

Centrally disposed within the display 22 is a layer 48 of bistable ferroelectric liquid-crystal material. The material of the layer 48 is contained between a top alignment layer 50 and a bottom alignment layer 52 disposed above and below the liquid crystal material, and by a circumferential seal 54 of epoxy, or similar sealant, which extends between the alignment layers 50 and 52. Spacers 56 (FIG. 3) of glass or similar inert material are also disposed between the alignment layers 50 and 52 to maintain a uniform spacing between the alignment layers 50 and 52 throughout the display 22. The alignment layers 50 and 52 are constructed typically of a polyimide or other suitable aligning material which serves to maintain alignment of molecules of the liquid-crystal material so as to ensure attainment of desired states of electrical polarization of the liquid-crystal material in response to imposition of an external electric field.

The external electric field for operating the liquid-crystal material is provided by a top set of electrodes 58 located between the top alignment layer 50 and the top glass plate 42, and a bottom set of electrodes 60 located between the bottom alignment layer 52 and the bottom glass plate 46. The electrodes 58 and 60 are formed of electrically conductive material such as indium-tin oxide. The electrodes 58 are arranged parallel to each other, and the electrodes 60 are arranged parallel to each other and substantially perpendicular to the electrodes 58. Orientation of the polarizers 40 and 44 is selected in accordance with well-known design procedures to provide for an image which is normally dark on a light background or normally light on a dark background. The most common orientation of the polarizers 40 and 44 is at or near to perpendicularity. With respect to the thickness of the liquid-crystal layer 48, determined by a spacing or gap between the alignment layers 50 and 52, typical values of the gap are 2 microns for the ferroelectric liquid-crystal material, this being smaller than typical values of gap such as 6 microns and 11 microns employed respectively for super twisted nematic liquid-crystal material and twisted nematic liquid-crystal material.

To facilitate description of the display 22, the top set of electrodes 58 will be referred to as column electrodes (FIG. 2) and the bottom set of electrodes 60 will be referred to as row electrodes. In the construction of a typical display 22, there may be a few hundred row electrodes, such as 400 electrodes, and several hundred or more column electrodes, such as 600–1000 electrodes. However, to simplify a description of the invention, FIG. 1 shows only a portion of each set of electrodes, and FIG. 2 shows nine column electrodes and nine row electrodes. The column electrodes 58 are identified further by the legends C1–C9, and the row electrodes 60 are identified further by the legends R1–R9. Each of the electrodes 58 has two ends, or terminals, one of which connects with the driver D3 and the other which connects with the driver D4. Similarly, each of the electrodes 60 has two terminals, one of which connects with the driver D1 and the other of which connects with the driver D2. To facilitate description of the interconnection, it is convenient to introduce the terms "front" and "back" for describing the terminals of the electrodes 58 and 60. Using this terminology, the front terminals of the electrodes 58 and 60 connect respectively via the grouping systems 28 and 26 to the drivers D3 and D1. Similarly, the back terminals of the electrodes 58 and 60 connect respectively via the permuting systems 32 and 30 to the drivers D4 and D2.

Connections of the drivers 24 via the grouping and permuting systems to the display 22, as depicted in FIG. 1, are shown in further detail in FIG. 2 wherein each of the drivers 24 is provided with a set of three output ports for applying electric signals to electrodes of the display 22. The ports of the drivers D1 and D3 coupled respectively to the grouping systems 26 and 28 are identified by the legends A, B, and C. The ports of the drivers D2 and D4 connected respectively to the permuting systems 30 and 32 are identified by the legends J, K, and L. It is noted that only three output ports are provided for each of the drivers 24 in FIG. 2 because there only nine column electrodes 58 and nine row electrodes 60. However, in a typical display wherein many more electrodes are employed, the drivers 24 would be provided with more output ports. Each of the grouping systems 26 and 28 is provided with a resistor bank 62 and, similarly, each of the permuting systems 30 and 32 is provided with a resistor bank 62. The front terminals of the column electrodes 58 are individually connected by resistors of a resistor bank 62 to the ports of the driver D3, with a further resistor bank 62 providing resistors for individual connection of the back terminals of the column electrodes 58 to the ports of the driver D4. Similarly, individual ones of the front terminals and the back terminals of the row electrodes 60 are coupled via resistors of the resistor banks 62 of the grouping system 26 and of the permuting system 30 respectively to the drivers D1 and D2.

In accordance with an aspect of the invention, the column electrodes 58 and the row electrodes 60 are arranged in groups which determine the connections of the respective electrodes via resistors with ports of the respective drivers. As depicted in FIG. 2, the front terminals of the column electrodes 58 are connected via three groups (identified by the legends G1, G2, and G3), to the output ports of the driver D3. A corresponding connection of the back terminals of the column electrodes 58 via three groups G1, G2, and G3 to the ports of the driver D4 is shown at the bottom of FIG. 2. The arranging of the connections in the three groups for the front terminals of the column electrodes 58 is provided by the grouping system 28. The arranging of the connections in the three groups for the back terminals of the column electrodes 58 is provided by the permuting system 32. In the same fashion, the grouping system 26 and the permuting system 30 provide for the arrangements of connections for the front terminals and the back terminals, respectively, of the row electrodes 60 into three groups (not shown in FIG. 2).

An important aspect of the invention, which makes possible the connection of many electrodes to a significantly smaller number of driver ports is the permuting of connections within the successive groups G1, G2, and G3 in each of the permuting systems 30 and 32. The maximum number of column electrodes 58 which can be accommodated by the interconnection system of FIG. 2 is equal to the square of the number of output ports of the driver D3 or D4. Both of the drivers have the same number of output ports. Similarly, both of the drivers D1 and D2 have the same number of output ports. The maximum number of row electrodes 60 which can be accommodated by the circuitry of FIG. 2 is equal to the square of the number of output ports of the driver D1 or D2. For example, if the drivers D1 and D2 each have four output ports, then a total of 16 row electrodes 60 can be accommodated. Similarly, if there were 10 output ports in either of the drivers D1 or D2, then a total of 100 row electrodes 60 could be accommodated. And if each of these drivers were to have 40 output ports, then a total of 1600 row electrodes 60 would be accommodated by the circuit arrangement disclosed in FIG. 2. Similar comments apply to the drivers D3 and D4 and the column electrodes 58.

The scheme of interconnection is disclosed in FIG. 2 with reference to the column electrodes 58. The same scheme is employed for connection of the row electrodes 60. With respect to the column electrodes 58, the first three electrodes C1, C2, and C3 connect via Group 1 to all three ports of the driver D3 and to all three ports of the driver D4. The column electrodes C4, C5 and C6 connect via Group 2 to all of the ports of the drivers D3 and D4. Similarly, the column electrodes C7, C8, and C9 connect via Group 3 to all of the ports of the drivers D3 and 4. However, with respect to the connections of the ports A, B, and C, of the driver D3, the first electrode in each group, namely the electrodes C1, C4, and C7, connect with the first port, namely port A. The second column electrodes in each group, namely the electrodes C2, C5, and C8, connect with the second port, namely the port B of the driver D3. The third and last column electrode in each of the groups, namely the electrodes C3, C6, and C9, connect with the last port, namely the port C. Therefore, with respect to connection of the front terminals of the column electrodes 58 to the driver D3, there is no permutation of the interconnections, the connections being accomplished with direct correspondence between the front terminals and the output ports such that the first terminal in each group connects with the first port, and the last terminal on each group connects with the last port. In the example of electrode configuration disclosed in FIG. 2, there are only three electrodes in each group and, accordingly, there is only one remaining electrode, namely the second electrode in each group. The second electrode in each group is connected to the second port of the driver D3. However, if there were five output ports to the driver D3, and five electrodes in each group, then the second electrode in each group would connect with the second driver port, the third electrode in each group would connect with the third driver port, and the fourth electrode in each group would connect with the fourth driver port.

However, in the permuting system 32, the interconnection scheme described above for the grouping system 28 is altered to provide for a permutation among the interconnections, the permutation being disclosed for the permuting system 32 in FIG. 2. The permutation is accomplished as follows. With respect to the first group, the scheme of interconnections is the same as that provided by the grouping system 28, namely, the first electrode C1 connects with the first port (port J) of the the driver D4, the second electrode C2 connects with the second port (port K) of the driver D4, and the third electrode C3 connects with the third port (port L) of the driver D4. In the second group of electrodes C4, C5, and C6 the scheme of interconnection is rotated by one terminal (or by one port) such that the second column C5 of the second group connects with the first port (port J), the third electrode C6 of the second group connects with the second driver port (port K) and the first electrode C4 of the second group connects with the last port (port L) of the driver D4.

In the third group of electrodes C7, C8, and C9, the permutation is continued by a further rotation in the relationship of interconnection of the back terminals of the column electrodes 58 to the ports of the driver D4. The third electrode C9 of the third group connects with the first port J, the first electrode C7 of the third group connects with the second port K, and the second electrode C8 of the third group connects with the third port L. By way of example, in the event that there five electrodes in each group, and that there were five driver ports J, K, L, M, and N (the latter two ports not being shown in FIG. 2) then the interconnection of five electrodes from such third group of electrodes to the ports J–N would be as follows: the third electrode connects with port J, the fourth electrode (not shown) connects with port K, the fifth electrode (not shown) connects with port L, the first electrode connects with port M, and the second electrode connects with port N.

A particular feature of the invention resulting from the foregoing scheme of interconnection is the mode of identifying individual ones of the row electrodes 60 and the column electrodes 58. Each of the electrodes is identified by two driver ports. For example, the column electrode C1 is connected between driver ports A and J. The column electrode C4 is connected between driver ports A and L, and the column electrode C7 is connected between driver ports A and K. Thus, the driver port A has three electrodes associated therewith, each of the three electrodes being connected to separate ones of the ports of the driver D4, namely the ports J, K, and L. In the event that there were five ports to each driver and five electrodes in each group, then there would be a total of five electrodes associated with port A, the five electrodes being connected to different ones of the ports of the driver D4 which, in this example, would be ports J, K, L, M, and N (the latter two ports not being shown in FIG. 2). Similar comments apply to the connection of the three electrodes from port B to separate ones of the ports J, K, and L, and connection of three other electrodes from port C to separate ones of the ports J, K, and L. This scheme of interconnection applies also to the row electrodes R1–R9 and the interconnection between the driver ports A, B, and C of the driver D1 and the ports J, K, and L of the driver D2.

Figure 4:
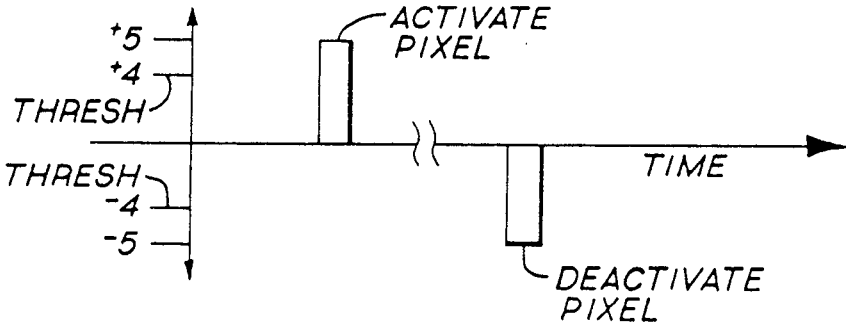
FIG. 4 is a timing diagram showing a presentation of a positive voltage pulse to activate a pixel and a subsequent presentation of a negative voltage pulse to deactivate the pixel.

With reference to FIGS. 3 and 4, the liquid-crystal material of the layer 48 is made to assume a specific state for optical interaction with incident light from the lamp 38 (FIG. 1) by the establishment of an electric field between a top (or column) electrode 58 at a bottom (or row) electrode 60. For example, in the use of the bistable ferroelectric liquid-crystal material of the invention, the establishment of a positive voltage of five volts of a top electrode 58 relative to a bottom electrode 60 is sufficient to establish a first stable state of the liquid-crystal material of the layer 48. The establishment of a negative voltage of five volts of the top electrode 58 relative to the bottom electrode 60 is sufficient to terminate the first state and produce the second of the two states of the bistable liquid-crystal material of the layer 48. Since the first state introduces a different amount of optical rotation to the incident light than does the second state, the first state serves to activate a pixel at the intersection of the top and the bottom electrodes 58 and 60 while the second state serves to deactivate the pixel at the intersection of the electrodes 58 and 60.

Depending on whether the image is presented as a dark image on a light background or a light image on a dark background, either one of the optical states of the liquid-crystal material can serve as activating or deactivating the state of the pixel. It is noted that the bistable ferroelectric liquid-crystal material responds much faster to an applied electric field than does nematic liquid-crystal material, the ferroelectric material responding in the order of microseconds while the nematic material responds on the order of milliseconds. Therefore, in order to establish an optical state for the ferroelectric material, it is sufficient to employ a single pulse having a duration in the microsecond range, after which the optical state remains fixed without need for further ones of these pulses. The optical state remains fixed until such time as it is desired to change the optical state, at which time a pulse of the opposite plurality, and preferably of the same pulse duration, is applied. Two such pulses of excitation voltage, applied between a top electrode 58 and a bottom electrode, are depicted in FIG. 4.

Figure 5:
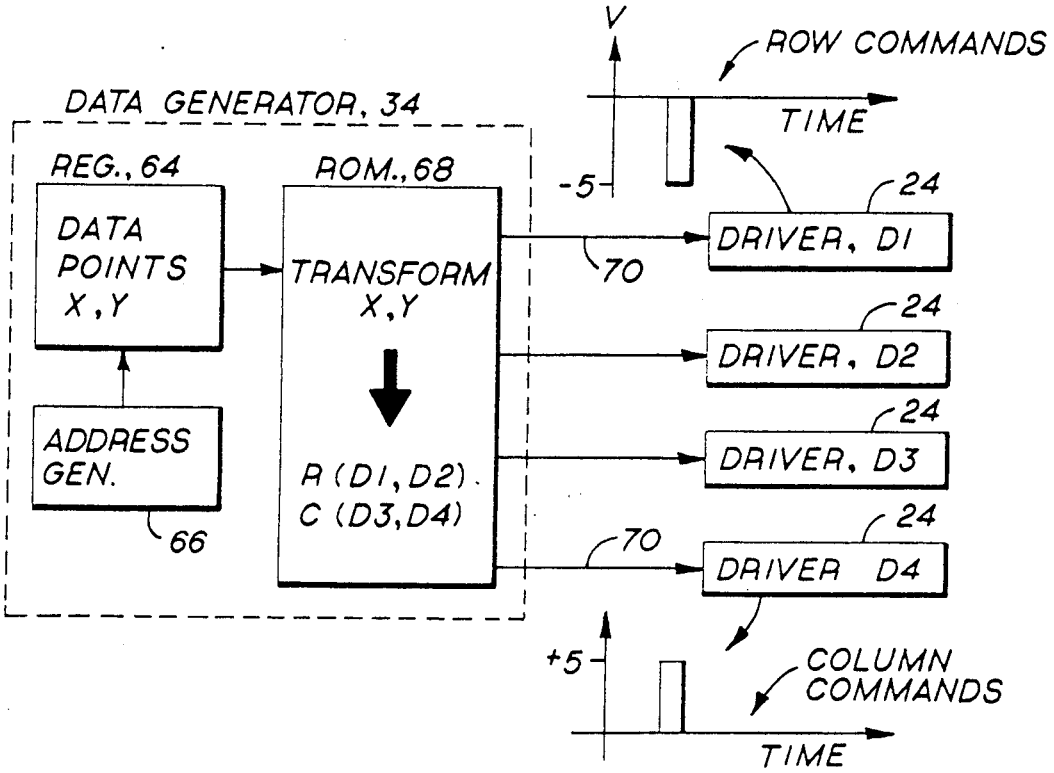
FIG. 5 is a diagrammatic view of a data generator of FIG. 1, the view showing interconnections of the data generator with electrode drivers of FIG. 1.

FIG. 5 shows components of the data generator 34 of FIG. 1. The generator 34 comprises a register 64 or other suitable memory, an address generator 66 for addressing the register 64, and a read-only-memory (ROM) which is addressed by output signals of the register 64 and outputs signals via separate lines 70 to the four drivers 24. In operation, data to be presented on the display 22 (FIG. 1) is stored first in the register 64 as a function of row and column coordinates of each pixel of the data to be displayed. This is represented in FIG. 5 by the terms (x) and (y) which represent respectively the row and the column coordinate of each data point in terms of the X and the Y coordinates of a Cartesian coordinate system 72 shown in FIG. 1.

In order to present the image on the display 22, the data is read out point by point from the register 64 into the memory 68 in response to an addressing of the register 64 with address signals provided by the generator 66. The memory 68 serves to transform the x coordinate to a double address for the row command, the double address consisting of an output of the driver D1 and an output port of the driver D2. Similarly, the memory 68 transforms the y coordinate to a double address for the column command, the double address consisting of an output of the driver D3 and an output of the driver D4. This is in accordance with the foregoing description of the row electrodes 60 and the column electrodes 58 (FIG. 2) wherein each electrode is identified by a pair of driver ports which are connected to terminals at opposite ends of an electrode. The relationship between the x and the y coordinates of a data point, and the corresponding identity of the row and the column electrodes is a fixed relationship ideally suited for storage in a read-only memory. Thereby, by inputting the x and the y coordinates as an address signal to the memory 68, the corresponding four identifications of the corresponding driver ports are readily outputted on the lines 70 as command signals to the drivers 24.

Upon receipt of a command signal along a line 70, a driver 24 provides an output voltage of requisite magnitude and sense, or zero volts. Assuming, by way of example, that a positive voltage is attained by driving a top electrode 58 positive with respect to a bottom electrode 60, then the drivers D3 and D4 connected to the column electrodes 58 are commanded to output a positive voltage of five volts while the drivers D1 and D2 connected to the row electrodes 50 are commanded to output zero volts. In the event that a negative voltage is to be applied by driving a bottom electrode 60 negative with respect to a top electrode 58, then the drivers D1 and D2 connected to the row electrodes 60 are commanded to output a negative voltage of five volts while the drivers D3 and D4 connected to the column electrodes 58 are commanded to output zero volts.

Figure 6:
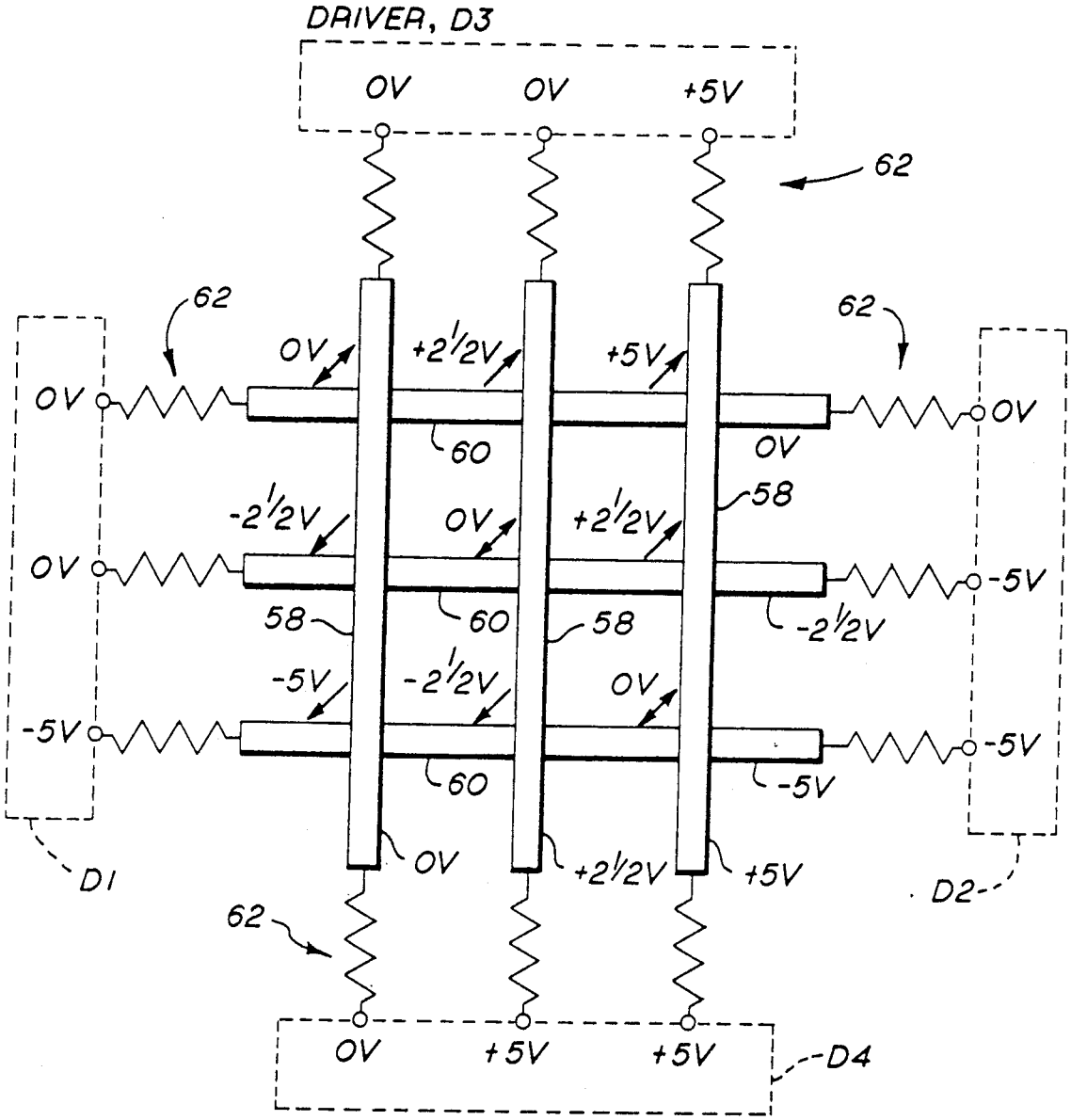
FIG. 6 is a diagrammatic representation of three column electrodes disposed above three row electrodes to demonstrate electric potentials developed at each of a plurality of intersections in response to specific energizations of the terminii of the electrodes via a set of resistors connected to ports of the drivers.

The voltages are explained further with respect to FIG. 6. The drivers D1 and D2 connected to the bottom row electrodes 60 output either zero volts or −5 volts in response, respectively, to the application of a logic-1 or logic-0 signal on line 70 to the drivers D1 and D2. Included with the signal on line 70 is a digital word identifying the output port of each driver 24 from which the output signal is to be provided. Similarly, the drivers D3 and D4 output either zero volts or +5 volts to the top column electrodes 58 in response, respectively, to a logic-1 signal or a logic-0 signal on line 70, the signal on line 70 including a digital word identifying the specific port of each of the drivers D3 and D4 which are to output the required voltage. The signals outputted by the ports of the drivers 24 are pulse signals, as has been portrayed in FIG. 4, and is portrayed also in the graphs appended to the drivers D1 and D4.

The application of voltages to the row and the column electrodes 60 and 58 is explained further with reference also to FIG. 6. FIG. 6 presents a simplified view of the circuitry in FIG. 2, FIG. 6 showing only a few of the electrodes coupled via the resistor banks 62 to the four drivers D1, D2, D3 and D4. The circuit of FIG. 6 demonstrates all possible combinations of voltages to show that only a specifically designated pixel can be activated. For the purpose of demonstrating operation, it is presumed that a threshold for operation of the bistable ferroelectric liquid-crystal material of the layer 48 (FIGS. 3 and 4) is +4 volts for activation of a pixel and −4 volts for deactivation of the pixel.

With respect to the column drivers D3 and D4, there are three possible combinations of voltages. At the left column electrode, zero volts is applied via resistors of the resistor banks 62 to both ends of the electrode. At the center column electrode, zero volts is applied at one end and +5 volts is applied at the other end leaving a net voltage of +2.5 volts at the electrode. At the right column electrode, +5 volts is applied at both ends of the electrode leaving a net voltage of 5 volts at the electrode. A similar set of three possible combinations of voltage is applied to the three row electrodes. This results in a difference of potential between various pairs of row and column electrodes as indicated in FIG. 6, the resultant differences in potential being arranged symmetrically in a matrix. Along one diagonal of the matrix, there is provided a zero difference of potential between row and column electrodes of equal voltage. Only two intersections provide efficient voltage, namely +5 volts and −5 volts, to establish an optical state to the liquid-crystal layer 48 (FIGS. 1 and 3). At the other intersections, the values of potential difference have magnitudes of either 2.5 volts or zero volts, this magnitude of voltage being below the magnitude of threshold voltage of four volts shown in the graph of FIG. 4. Therefore, a pixel of the display 22 can be identified unambiguously by a pair of driver ports exciting a column electrode and a second pair of driver ports exciting a row electrode.

With respect to the grouping of electrodes shown in FIG. 2, it is noted that one or more electrodes may be eliminated in one or more of the groups, and the invention still functions to provide for unambiguous identification and selection of electrodes. For example, if there were only six column electrodes, the six column electrodes could be evenly divided among the three groups G1, G2, and G3 in which case there would be two electrodes associated to each group. Alternatively, any one of the groups could be eliminated in its entirety leaving two groups of three column electrodes. The arrangement shown in FIG. 2 represents the maximum number of column electrodes and the maximum number of row electrodes which can be activated by the drivers. As noted hereinabove, the grouping and permuting of the connections permits the drivers to handle a number of electrodes equal to the square of the number of ports in a driver. This is a much larger number of electrodes than can be handled by drivers in circuitry of the prior art wherein one driver port is assigned to only one electrode. It is also appreciated that the use of the faster response ferroelectric liquid-crystal material, in conjunction with the bistable characteristic which obviates the need for repetitive refreshing of the pixel excitation voltages, greatly reduce requirements of current drive and power handling capacity of the electrode excitation circuits.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A liquid-crystal display system comprising:

a liquid-crystal display device having a layer of liquid-crystal material, a first set of column electrodes disposed on a first side of said layer and a second set of row electrodes disposed on a second side of said layer opposite said first side, electrodes of said first set being oriented substantially perpendicularly to electrodes of said second set, each of said electrodes having a front terminal and a back terminal;

a first driver and a second driver connected respectively to said front and back terminals of said column electrodes, and a third driver and a fourth driver connected respectively to said front and back terminals of said row electrodes, each of said drivers having a series of ports connectable to a respective series of column electrodes or series of row electrodes, for energizing the electrodes to present an image on said display;

a first grouping means and a second grouping means interconnecting said first driver and said third driver, respectively, with front terminals of their respective row and column electrodes, said first and said second grouping means arranging the front terminals of the electrodes connected to the respective grouping means into groups wherein, in each of said groups, the front terminals are connected in seriatim to successive ports of a drive; and a first permuting means and a second permuting means interconnecting said second driver and said fourth driver, respectively, with back terminals of their respective column and row electrodes, said first and said second permuting means arranging the back terminals of the electrodes connected to the respective permuting means into groups corresponding to the groups established by said grouping means wherein, in each of a succession of the groups of the permuting means, the back terminals are connected in seriatim to successive ports of a driver by permutation of connections among the succession of groups.

2. A system according to claim 1 wherein said liquid-crystal material is a bistable material.

3. A system according to claim 2 wherein said liquid-crystal material is a ferroelectric material.

4. A system according to claim 1 wherein, in each of the permuting means, a permutation of the back terminals of a set of electrodes is accomplished by a rotation of a sequence of connection in successive ones of the groups wherein:

in a first of the groups, the back terminals are connected to corresponding ports of said second and fourth drivers;

is a second of the groups, a first back terminal is connected to a last one of the driver ports and a second one of the back terminals is connected to a first one of the driver ports; and in a third of the groups, a second of the back terminals is connected to the last port and the third back terminal is connected to the first port.

5. A liquid-crystal display system comprising:

a layer of liquid-crystal material;

a set of electrodes in electrical contact with said layer for exciting a state of liquid-crystal material which induces a predetermined rotation to a light wave propagating through the liquid-crystal material, each electrode of said set having a front terminal and a back terminal;

a first driver having a series of output ports connected by a first interconnection arrangement to front terminals of the electrodes;

a second driver having a series of output ports connected by a second interconnection arrangement to back terminals of the electrodes; and wherein in said first interconnection arrangement, said front terminals are arranged in groups, and the output ports of said first driver are connected in seriatim to corresponding terminals in each of said groups; and in said second interconnection arrangement, said back terminals are arranged in groups, and the output ports of said second driver are connected in seriatim to separate permutations of corresponding terminals in respective groups of said second interconnection arrangement, said first and said second interconnection arrangements allowing each of said electrodes to be unambiguously identified by a pair of ports wherein the first of said pair of ports is a port from said series of output ports connected to said first driver and the second of said pair of ports is a port from said series of output ports connected to said second driver.

6. A system according to claim 5 wherein said liquid-crystal material is a bistable material.

7. A system according to claim 6 wherein said liquid-crystal material is a ferroelectric material.

8. A system according to claim 5 wherein the permutations of terminals in respective groups of the back terminals of said electrodes is accomplished by a rotation of a sequence of connection in successive ones of the groups wherein:

in a first of the groups, the back terminals are connected to corresponding ports of said second driver;

in a second of the groups, a first back terminal is connected to a last one of the driver ports and a second one of the back terminals is connected to a first one of the driver ports; and in a third of the groups, a second of the back terminals is connected to the last port and the third back terminal is connected to the first port.

* * * * *